US008201802B2

(12) United States Patent
Sum

(10) Patent No.: US 8,201,802 B2
(45) Date of Patent: Jun. 19, 2012

(54) FORMWORK ELEMENT WITH IDENTIFICATION MEANS

(75) Inventor: Walter Sum, Steinach (DE)

(73) Assignee: Pascal-Werk G. Maier GmbH, Steinach (DE)

( * ) Notice: Subject to any disclaimer, the term of this patent is extended or adjusted under 35 U.S.C. 154(b) by 482 days.

(21) Appl. No.: 12/525,392

(22) PCT Filed: Feb. 14, 2008

(86) PCT No.: PCT/EP2008/001110

§ 371 (c)(1),
(2), (4) Date: Jul. 31, 2009

(87) PCT Pub. No.: WO2008/098755

PCT Pub. Date: Aug. 21, 2008

(65) Prior Publication Data

US 2010/0059656 A1 Mar. 11, 2010

(30) Foreign Application Priority Data

Feb. 16, 2007 (DE) ..... 10 2007 008 303

(51) Int. Cl.
*E04G 9/10* (2006.01)

(52) U.S. Cl. ..... 249/189

(58) Field of Classification Search ..... 249/33, 249/188, 189
See application file for complete search history.

(56) References Cited

U.S. PATENT DOCUMENTS 6,363,635 B1 * 4/2002 England ..... 40/124.5
6,667,092 B1 * 12/2003 Brollier et al. ..... 428/182
6,722,814 B2 * 4/2004 Byrne ..... 404/35
2002/0007601 A1 * 1/2002 England ..... 52/103
2010/0033297 A1 * 2/2010 Patovirta ..... 340/5.1

FOREIGN PATENT DOCUMENTS

| | | | |
|---|---|---|---|
| DE | 2426708 | | 12/1975 |
| DE | 20005975 | | 8/2000 |
| DE | 10055060 | | 5/2002 |
| DE | 102008000381 | * | 8/2009 |
| DE | 102009012864 | * | 9/2010 |
| EP | 0729536 | | 7/1997 |

* cited by examiner

*Primary Examiner* — Michael Safavi

(74) *Attorney, Agent, or Firm* — Volpe and Koenig, P.C.

(57) ABSTRACT

A formwork element (1) with a lining skin (2) and, arranged on an edge or close to an edge of the lining skin (2), at least one metal edge web (3) or outer frame or carrier (4) supporting the lining skin (2) comprises identification means in the form of a transponder (6) which is arranged in a depression (7) of an edge web (3) or outer frame or carrier (4) on its surface which is directed away from the lining skin (2) and which, in the use position, is directed towards an adjacent formwork element. This depression (7) encloses the transponder (6) laterally and on one face such that only one surface is accessible to the outside for a detector since the depression (7) is closed on that side of the edge web (3) or frame or carrier (4) situated in the direction towards the center of the lining panel or the formwork element (1). The transponder (6) is held in the depression (7) by means of a polymer and/or adhesive compound (8).

8 Claims, 6 Drawing Sheets

FORMWORK ELEMENT WITH IDENTIFICATION MEANS

BACKGROUND

The invention relates to a formwork element with a lining skin and with at least one metal edge web or outer frame or carrier supporting the lining skin which protrudes from the lining skin, at an edge or close to an edge thereof, on the side remote from the concrete in the use position, at least one transponder being arranged as identification means on the formwork element wherein there is provided, on the edge web or outer frame or carrier, on the surface thereof that is remote from the lining skin and in the use position faces a neighboring formwork element or building part, at least one depression which is larger than a flat transponder, and in that the transponder is arranged and held in this depression, surrounded by the boundary thereof.

An example of a formwork element with an annular web or outer frame protruding at the edge of the lining skin is described in EP 0 573 450 B1.

A further example is disclosed in EP 0 729 536 B1.

DE 24 26 708 C3 discloses a formwork element with carriers supporting the lining skin, wherein the formwork elements can in this case be or become curved, although comparable formwork elements in the form of rigid lining panels with corresponding, for example parallel, carriers are also known.

Formworks, and thus the formwork elements, are mostly leased or claimed temporarily by customers' leasing agreements; that is to say, there is the problem, in formworks and formwork elements of this type, that the formwork elements which are used have to be returned again after a certain time.

In this case, it is often not possible to be sure whether the temporary user is really returning those formwork elements which he had rented or leased and there is the risk that the user will keep for himself formwork elements or formwork parts which are still in good condition and return less good-quality or more worn formwork elements or formwork parts in his possession.

It is therefore desirable to mark formwork elements or at least more valuable lining panels in such a way that they can be identified and recognized when returned.

In addition to color markings, transponders have also become known in this regard.

From DE 200 05 975 U1, it is known, in the case of frame formworks with metal frames which are formed by a box profile, to insert a hollow-rivet-shaped spacer part composed of plastic in an aperture of the peripheral wall of the box profile, the central bore of which spacer part serves to hold a transponder. This means that said hollow-rivet-shaped spacer part must be produced from plastic and installed, and that the metal frame requires a hole, which causes weakening, for the insertion of said spacer part which serves as a holder for the transponder.

SUMMARY

There is therefore the object of providing a formwork element of the type mentioned at the outset, the edge webs or outer frame or carrier of which can be made of metal, without a special holder for the transponder or transponders being required and having to be installed.

In order to achieve this object, it is provided, in the case of a formwork element of the type defined at the outset, that the edge web(s) are formed from flat material and the depression is embossed, or that the edge web is a profile or extruded profile or hollow profile or rectangular profile, and the depression is formed or milled out, by cutting or non-cutting removal of material, that the depression is closed on the side of the edge web or the frame or the carrier that is located in the direction toward the center of the lining panel or the formwork element, and that the transponder is held or fastened in the depression by a plastics material and/or adhesive compound and is embedded into the plastics material and/or adhesive compound.

Instead of a complex holder, there is therefore formed in the corresponding metallic part of the formwork element, which is above all readily accessible from the outside even in the case of formwork elements stacked one upon another, a depression in which, in the use position, the transponder is accommodated in an insulated manner, so that its electromagnetic signals can be effectively issued or received by the transponder without being disturbed or "swallowed" by the surrounding metal of the edge web, frame or carrier. As a special holder is avoided, a holder of this type does not have to be specially mounted either. Compared to a through-hole, a depression has the advantage that forming it entails almost no additional effort, although the edge web, frame or carrier is weakened less or not at all.

In this case, the transponder can easily and expediently be introduced or inserted into the depression together with or after or before the application of an appropriate plastics material or adhesive compound or be secured then using the aforementioned compound, as a result of which it can at the same time also still be protected from mechanical damage or from damage stemming from soiling. It is, moreover, to be regarded as advantageous in this case that the depression is closed or—if appropriate retrospectively—sealed on the side of the edge web or frame or carrier that is located in the direction toward the center of the lining panel. Thus, the open side of this depression is readily accessible from the outer side for an appropriate sensor or scanner or detector.

The application of the depression by means of an embossing process is easy to carry out and offers an effective possibility for shaping the depression, which is open toward the outer side, for the transponder without impairing the stability of the edge web or frame part.

It is however also possible for the edge web to be, substantially in accordance with EP 0 729 536 B1, a profile or extruded profile or a hollow profile, including a hollow profile made of steel, and for the depression to be formed, in particular milled out, by cutting or non-cutting removal of material. In addition to a cutting milling process, erosion of the corresponding depression would also be conceivable.

In this case, it may be advantageous if the edge web is an aluminum extruded profile with cavities extending in the longitudinal direction thereof—in order to save weight with good rigidity—and if the depression is arranged at a location at which the extruded profile has a full cross section—i.e. not a cavity.

The flat material which forms the edge web(s) and which has the embossed depression may be a boundary of a hollow profile which is arranged at or encircles the edge of a formwork element.

A particularly expedient embodiment can provide for the formwork element to be a lining panel with a metallic outer frame consisting of edge webs, which are made of flat material and protrude substantially at right angles to the lining skin, or of a profile, the cross section of the edge web being directed away from the lining skin up to a free or set-apart edge, edge webs of neighboring lining panels indirectly or directly abutting the edge webs in the use position and connecting means acting for mutual fastening of the abutting or adjacent edge webs, and for the depression receiving the transponder to be shaped, on the outer side, which is located in the direction away from the center of the lining panel, of the edge web or webs, so as to recoil, relative to this outer side, in the direction toward the center of the lining panel.

The edge-side edge web or outer frame can therefore have, on that surface which faces any neighboring lining panel, the corresponding depression which opens in this case toward this outer side; that is to say, the transponder can be inserted into the depression from this outer side and then also be readily detected from this outer side.

In the use position, the transponder can be sunk into the depression sufficiently far that it is covered or concealed, at its side facing the outer side, by the plastics material and/or adhesive compound, and this covering of the transponder can preferably be flush with the outer face of the edge web or outer frame or carrier. Such a flush arrangement then produces a surface of the edge web or carrier, on which the position of the transponder is not readily discernible to unauthorized parties and soiling of the transponder is substantially avoided. Nevertheless, the transponder is additionally protected by the cover from even more aggressive materials such as laitance or similar soiling and also from mechanical impingement. As a result, the transponder in the depression can also readily be embedded into the plastics material and/or adhesive compound.

This plastics material and adhesive compound can therefore first be poured into the depression and the transponder then be pressed into the compound, which is still accordingly resilient, and as a result be embedded, or the transponder can first be inserted and the compound then be poured into the depression, which already contains the transponder, the transponder being in this case at least outwardly covered by the compound.

It is in this case particularly advantageous if the plastics material and/or adhesive compound is an epoxy resin-based two-component adhesive. This produces on the one hand, after setting or curing, a stable closure, which protects the transponder effectively, and allows on the other hand long-lasting, secure fastening of the transponder in its depression.

So that, during stacking of formwork elements of this type, the position of the transponder does not have to be allowed for, while the identification of the particular lining panel is still possible without difficulty, it is expedient if the formwork element is a rectangular lining panel having at least two transponders in mutually set-apart depressions in edge webs or carriers arranged at right angles or parallel to one another. Parallel edge webs or carriers close to the edge are located in each case at mutually set-apart edges, so that the lining panels present to the user again, even when deposited in a position rotated through 180 degrees, an edge web or carrier in which one of the transponders is then accommodated. In this case, all the transponders of a lining panel can of course have the same identification features.

It may in this case be advantageous if a respective depression for a transponder is provided in at least two edge webs or carriers, in each case close to a corner of the rectangular formwork element. As a result of such an arrangement close to a corner, the transponder might be readily detectable even when the edge web containing it extends away from the user, because the transponder is then nevertheless located close to the user at the corresponding corner of the formwork element.

The transponder or transponders can be even easier to use if the two depressions on the formwork element oppose each other substantially centrally and/or on a line extending through the center of the formwork element. Even in a position rotated 180 degrees, in each case one of the transponders is then located in a readily detectable region of the stack.

In this case, it is advantageous, above all for the manufacturing costs of the lining panels, if the transponder is a passive transponder, although the use of an active transponder would also be similarly conceivable.

Above all a combination of individual ones or a plurality of the features and measures described hereinbefore produces a formwork element with metallic edge webs or carriers, on which formwork element transponders can be accommodated so as to be readily detectable and nevertheless protected without this requiring special holders. Nevertheless, the corresponding edge webs, carriers or outer frames can be made of metal, as the transponders are accommodated so as to be shielded and protected in the corresponding embossed or milled-out depressions, without these edge webs, frame parts or carriers necessitating weakening through-holes and matching special holders for the transponders.

BRIEF DESCRIPTION OF THE DRAWINGS

Exemplary embodiments of the invention will be described hereinafter in greater detail with reference to the drawings, some of which are schematic illustrations and in which.

DETAILED DESCRIPTION OF THE PREFERRED EMBODIMENTS

Figure 1:
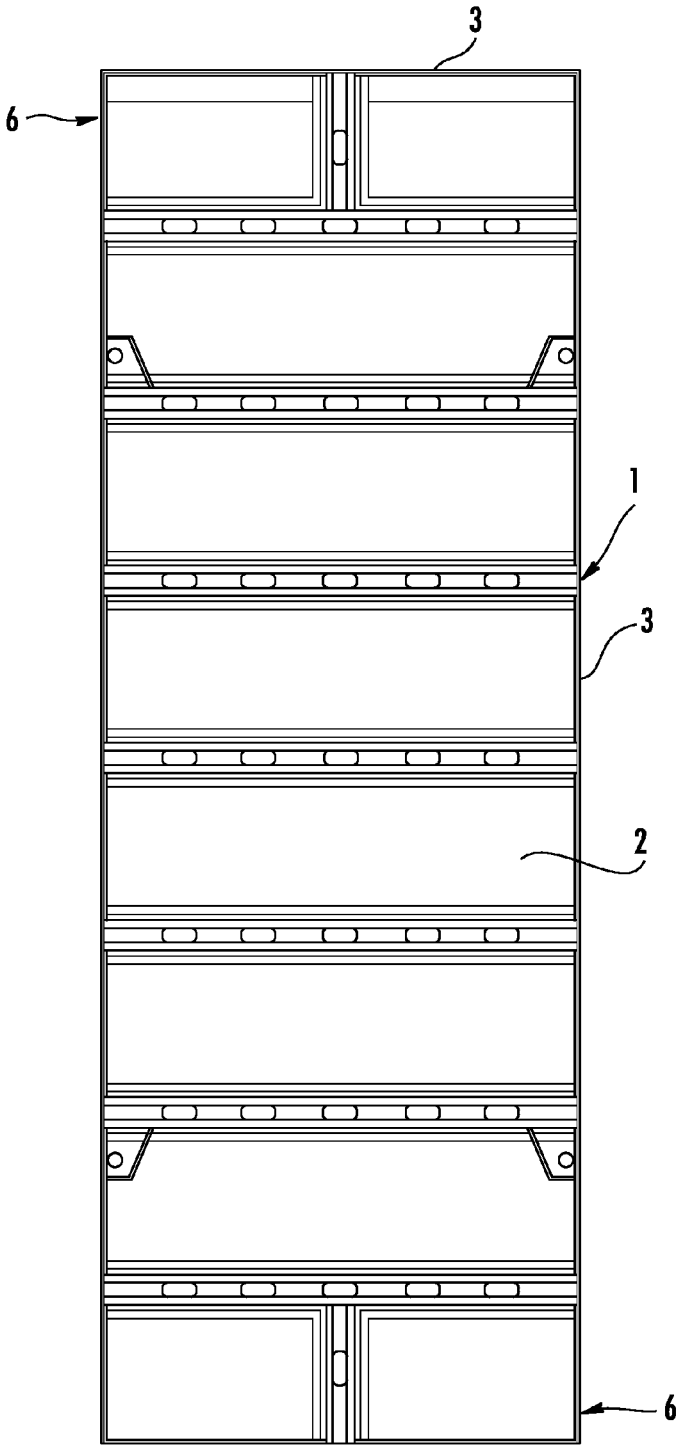
FIG. 1 is a rear view of a lining panel, looking onto the side which is remote from the concrete in the use position, with edge webs arranged on all four sides of the rectangular lining panel, like the lining panel according to EP 0 573 451 B1.
Figure 2:
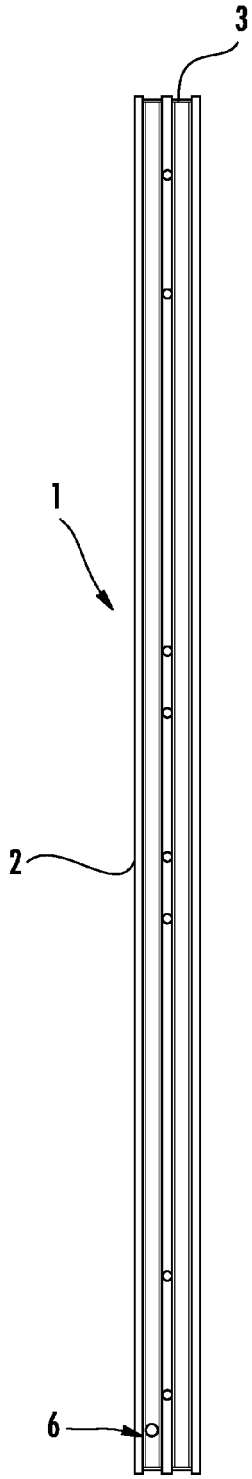
FIG. 2 is a side view of the lining panel according to FIG. 1, looking onto the outer side of an edge web.

In the subsequent description, functionally corresponding parts are denoted by corresponding reference numerals, even if they are configured differently.

Figure 3:
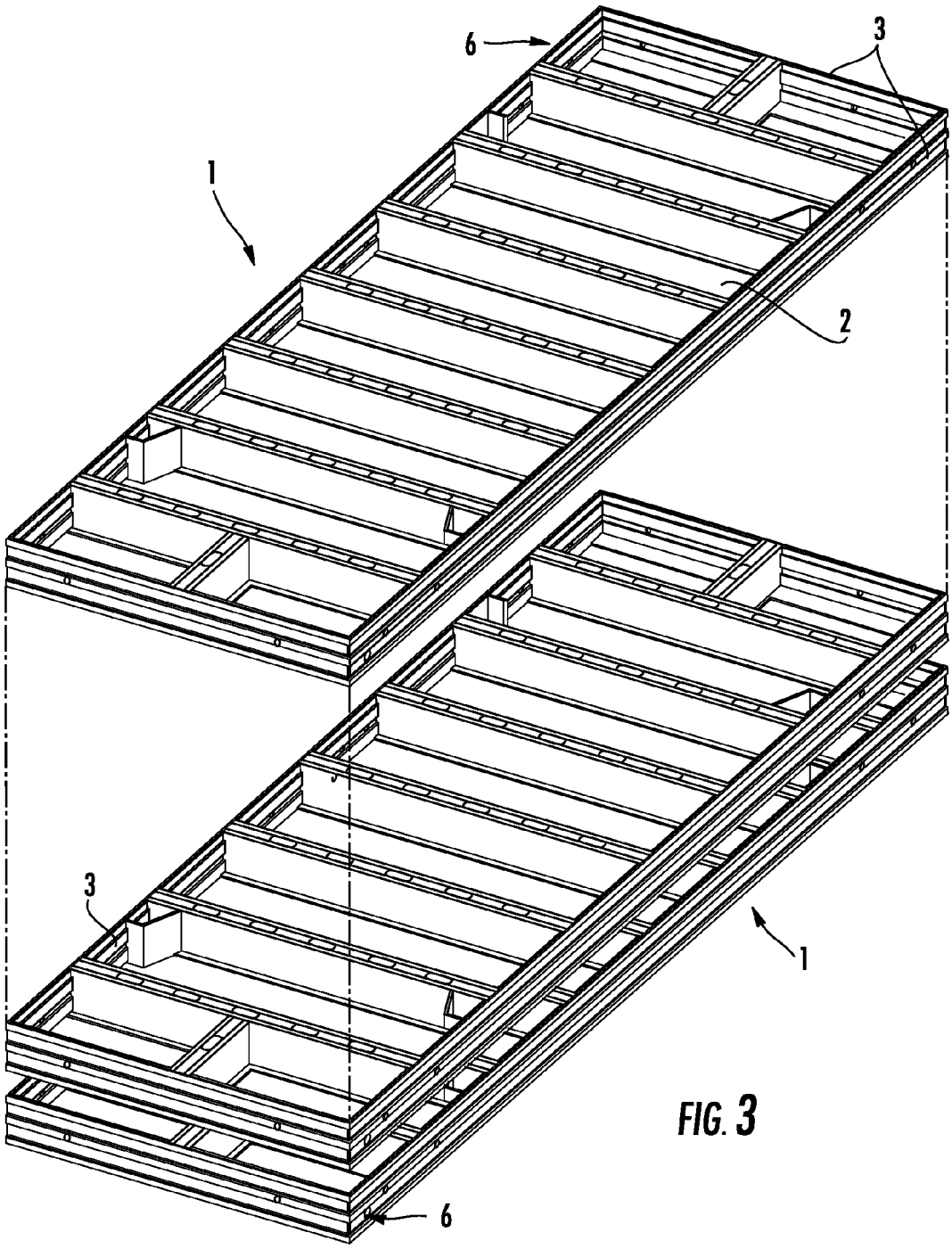
FIG. 3 shows a stack or the stacking of a plurality of lining panels according to FIG. 1.
Figure 4:
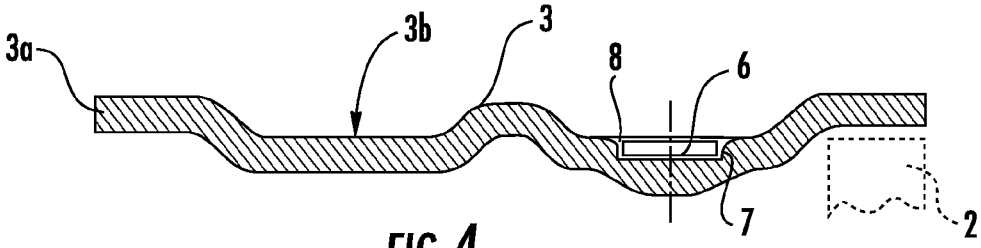
FIG. 4 is an enlarged cross section of an edge web of the lining panel according to FIGS. 1 to 3 in the region of a depression receiving a transponder in accordance with the invention.
Figure 5:
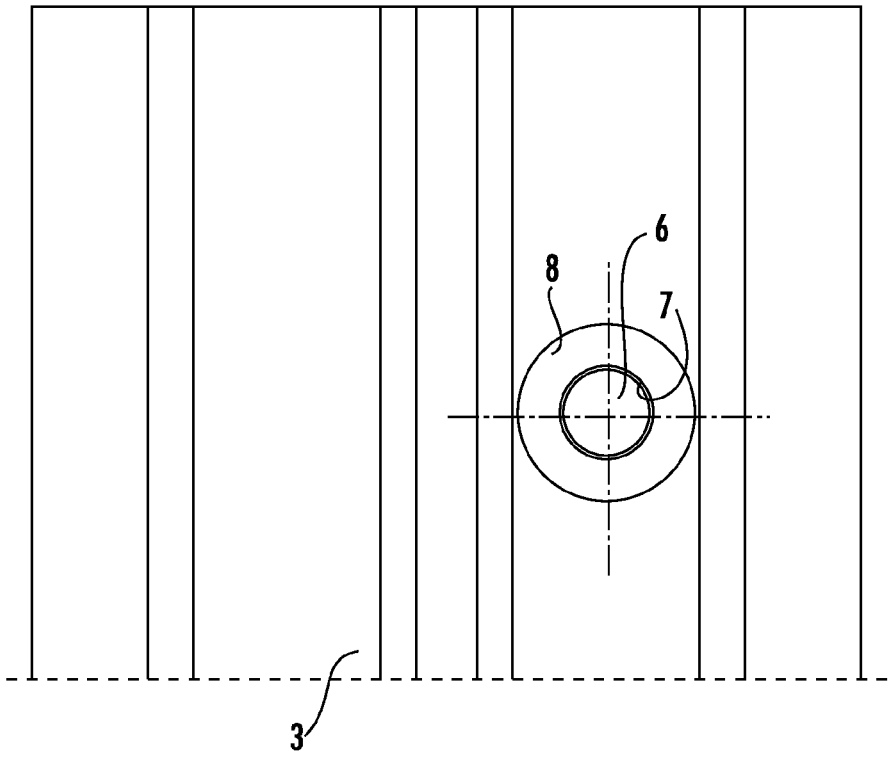
FIG. 5 is a partial view of the edge web according to FIG. 4, looking onto the depression and the transponder arranged therein.
Figure 6:
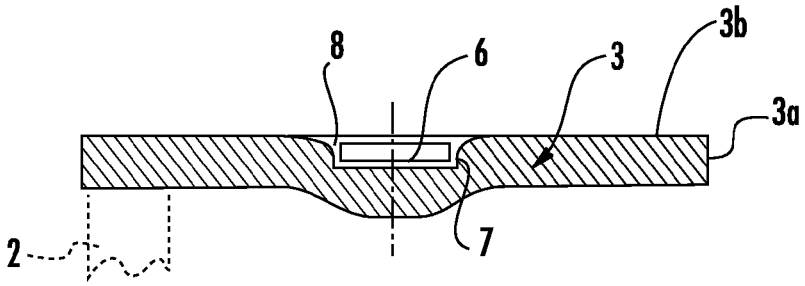
FIG. 6 is a cross section of a modified, similar edge web with a depression and transponder, wherein this web could also be the boundary web of a profile or a closed profile, for example a hollow profile having in particular a rectangular cross section, which web faces, when the lining panels abut, the hollow profile or edge web of a neighboring formwork element.
Figure 7:
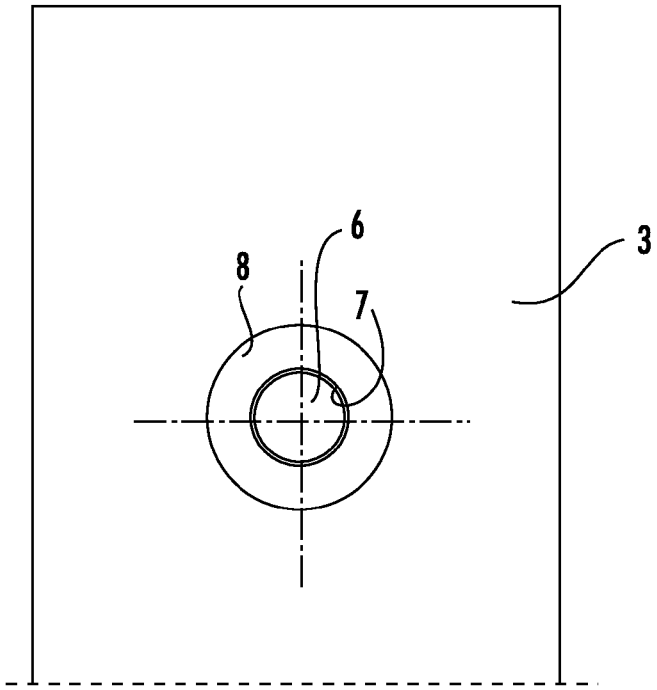
FIG. 7 is a view of the edge web in the region of the depression and the transponder according to FIG. 6.
Figure 8:
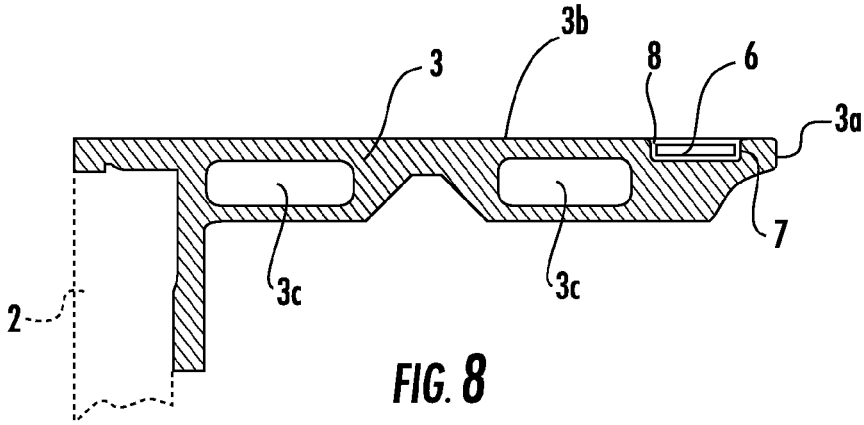
FIG. 8 is a cross section of an edge web of a lining panel, for example in accordance with EP 0 729 536 B1, the sectional line extending through a formed, preferably milled-out depression and a flat transponder arranged therein.

A formwork element, denoted in its entirety by reference numeral 1, may be a lining panel of differing design, such as may be seen for example from FIGS. 1 to 5, 6 and 7, 8 and 9 or 10 and 11. A common feature of these differently configured formwork elements 1 is the fact that they have a lining skin 2 which is also indicated in FIGS. 4, 6 and 8 by broken lines. This clearly shows that there protrude from the particular lining skin 2, at or close to the edge thereof, on the side which is remote from the concrete in the use position, metal edge webs 3 which in the exemplary embodiment according to FIGS. 1 to 3 can also form an outer frame.

Figure 11:
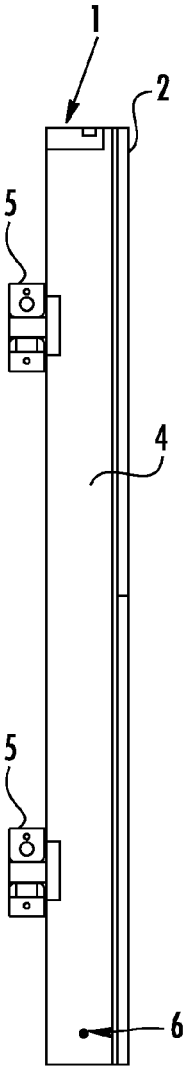
FIG. 11 is a side view of the large-area switching panel according to FIG. 10, looking onto a carrier which is close to the edge.
Figure 10:
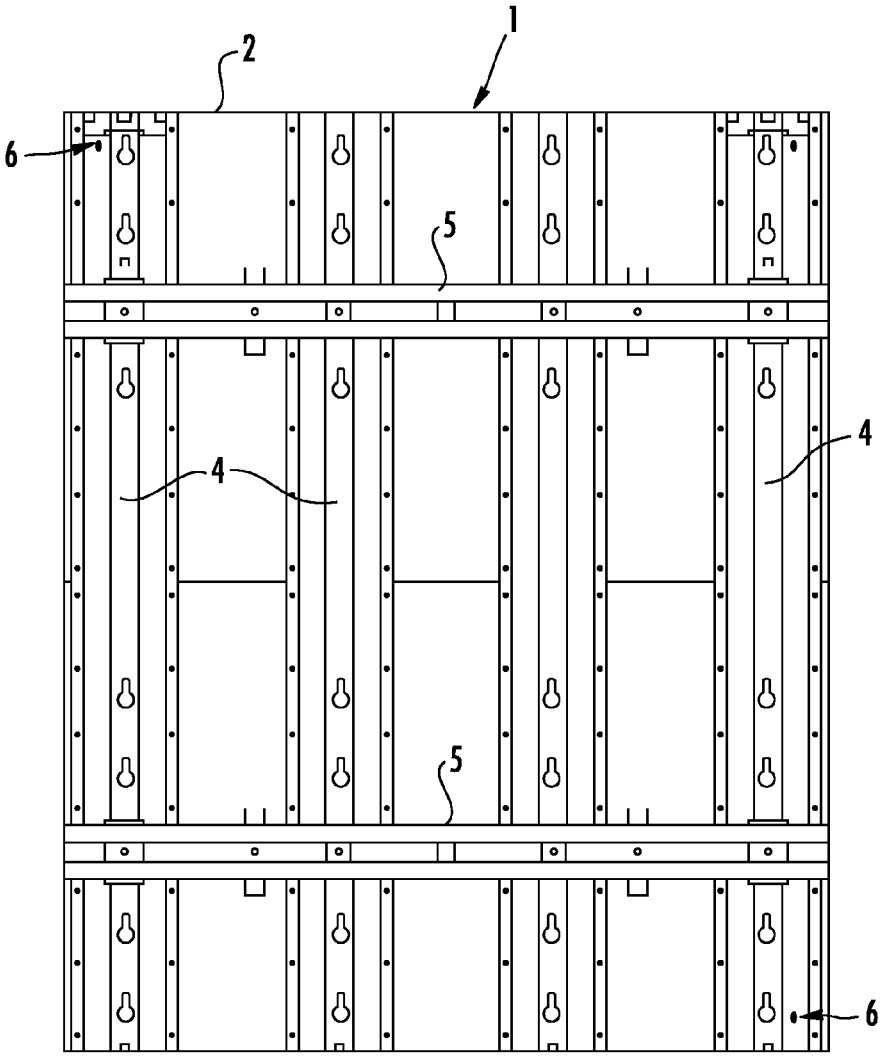
FIG. 10 is a view of a large-area formwork with, in the use position, vertical carriers for supporting a lining skin, which carriers are connected by a waler line, for example in accordance with DE patent 24 26 708, the carriers which are in each case close to the edge containing transponders; and also

In the exemplary embodiment according to FIGS. 10 and 11, the lining skin 2 is supported by parallel carriers 4 which are vertical in the use position, wherein there extend in this case too, close to the edge of the lining skin 2, carriers 4 of this type which can additionally be connected by a waler line 5. Depending on the configuration of the waler line 5, said waler line is rigid or if appropriate, as in DE 24 26 708 C3, also length-variable in order to curve the lining skin.

A common feature of all the exemplary embodiments is the fact that at least one transponder 6 is arranged as an identification means on the particular formwork element 1.

It is in this case apparent from all the exemplary embodiments and particularly clear from FIGS. 4 to 9 that there is provided on the particular edge web 3 or carrier 4, on the surface thereof that is remote from the lining skin 2 and in the use position faces a neighboring formwork element 1 or a building part or a corner, at least one depression 7, which is larger than a flat transponder 6, and that the transponder 6 is arranged and held in this depression 7, surrounded by the boundary thereof.

Above all FIGS. 4, 6 and 8 clearly reveal that the depression 7 surrounds and comprises the transponder, both at its under side and at its circumference, and leaves exposed only its upper side which is in this way readily detectable.

In this case, the transponder 6 is held and fastened in the depression 7 by a plastics material and/or adhesive compound 8, referred to hereinafter also as the "compound 8", as is particularly apparent on viewing FIGS. 4 and 5 together. Above all in the exemplary embodiment according to FIG. 7, the compound 8 encompasses in this case also the outer edges of the depression 7 to attain effective mounting. The same applies to the embodiment according to FIGS. 6 and 7.

In all the exemplary embodiments, provision is made for the depression 7 to be closed, if appropriate also retrospectively sealed, on the side of the edge web 3 or frame or carrier 4 that is located in the direction toward the center of the lining panel or the formwork element 1; that is to say, the edge web 3 or carrier 4 is not weakened by a through-bore or continuous hole.

The exemplary embodiments according to FIGS. 1 to 7 disclose a formwork element 1 in the form of a lining panel with a metallic outer frame consisting of edge webs 3, which are made of flat material and protrude substantially at right angles to the lining skin 2, or if appropriate of a profile, the cross section of the particular edge web 3 being directed away from the lining skin 2 up to a free edge 3*a*, wherein, in the use position, edge webs of neighboring lining panels indirectly or directly abut the edge webs 3 and connecting means can act for mutually fastening edge webs, abutting in this manner, of continuing lining panels. The depression 7, which receives the transponder 6, is in this case formed, on the outer side 3*b*, which is located in the direction away from the center of the lining panel 1, of the particular edge web 3, so as to recoil, relative to this outer side 3*b*, in the direction toward the center of the lining panel. The same applies to an edge web 3, which is embodied as an extruded profile, according to FIGS. 8 and 9.

In the exemplary embodiments according to FIGS. 1 to 7, the edge webs 3 are formed from flat material and the depression 7 is embossed, i.e. generated by cold deformation. The strength of the edge web is accordingly high even in the region of this depression 7.

Figure 9:
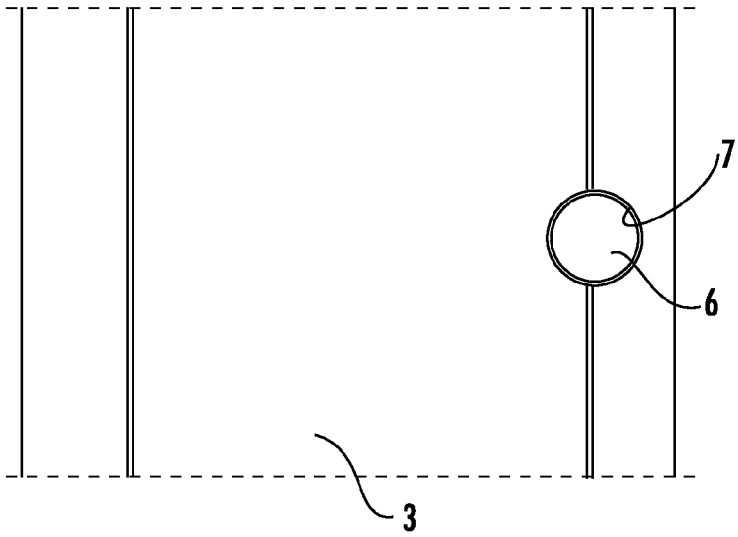
FIG. 9 is a view of the edge web according to FIG. 8 in the region of the depression and the transponder.

In the exemplary embodiment according to FIGS. 8 and 9, the edge web 3 is, as mentioned hereinbefore, an extruded profile and the depression 7 is formed, for example milled out, by cutting or else non-cutting removal of material. In this case, this edge web 3 may be an aluminum extruded profile with cavities 3*c* extending in the longitudinal direction thereof and the depression 7 can be arranged at a location at which this extruded profile has a full cross section, so that, again, weakening of this edge web 3 is substantially prevented by the depression 7.

The transponder 6 can however also be arranged in a depression 7 of at least one of the boundary webs of a hollow profile, for example a closed hollow profile or rectangular profile, provided that this web is sufficiently strong. For example, the flat profiles illustrated in FIG. 4 or 6 could also each be an, in particular external, boundary of a hollow profile of this type which could be arranged at or else encircle the edge of a corresponding formwork element 1.

In all the exemplary embodiments, the transponder 6 is, in the use position, sunk into the depression 7 sufficiently far that the side thereof facing the outer side 3*b* is covered or concealed by the plastics material and/or adhesive compound 8 and this covering of the transponder is in this case, as shown in FIGS. 4, 6 and 8, flush with this outer face of the outer side 3*b* of the edge web 3 or carrier 4, so that the transponder 6 is not only well protected, but also hidden, so that undesirable handling and also mechanical damage are substantially ruled out.

Above all the aforementioned illustrations in FIGS. 4, 6 and 8 show in this case that the transponder 6 in the depression 7 is embedded into the compound 8, i.e. is surrounded thereby on almost all sides. In this case, this compound 8 may be an epoxy resin-based two-component adhesive which securely mounts the transponder 6 in the depression 7 and also effectively protects said transponder from all types of damage.

FIGS. 1, 3 and 10 also indicate that the formwork element 1, which is in each case a rectangular lining panel, has at least two transponders 6 in mutually set-apart depressions 7 in edge webs 3 or carriers 4 arranged at right angles or parallel to one another, so that the position of the transponder 6 does not have to be taken into account when stacking the lining panels; on the contrary, one of the transponders 6 is arranged at all times in a position which is advantageous for detecting.

In the exemplary embodiments, at least one depression 7 for a transponder 6 is provided in each case in at least two edge webs 3 or carriers 4, in each case close to a corner of the rectangular formwork element 1. However, it is just as advantageous or even more advantageous if the two depressions 7 on the formwork element 1 oppose each other substantially at the center of an edge web 3 or carrier 4 and/or on a notional line extending through the center of the formwork element 1.

In this case, in the exemplary embodiment, a passive transponder 6 is provided, so that it does not significantly increase the costs of the formwork element 1.

The formwork element 1, with a lining skin 2 and at least one metal edge web 3 or outer frame or carrier 4 supporting the lining skin 2, which is arranged at an edge or close to an edge of the lining skin 2, has as identification means a transponder 6 which is arranged in a depression 7 of an edge web 3 or outer frame or carrier 4, on the surface thereof that is remote from the lining skin 2 and in the use position faces a neighboring formwork element. This depression 7 surrounds the transponder 6 laterally and on a face, so that only a surface toward the outer side is accessible for a detector, because the depression 7 is closed on the side of the edge web 3 or frame or carrier 4 that is located in the direction toward the center of the lining panel or the formwork element 1. The transponder 6 is mounted in the depression 7 with the aid of a plastics material and/or adhesive compound 8.

The invention claimed is:

1. A formwork element (1) for concrete comprising a lining skin (2) and at least one metal edge web (3) or outer frame or carrier (4) supporting the lining skin (2) which protrudes from the lining skin (2), at an edge or close to an edge thereof, on a side remote from the concrete in a use position, at least one transponder (6) being arranged as identification on the formwork element (1), wherein there is provided, on the edge web (3) or outer frame or carrier (4), on a respective surface thereof that is remote from the lining skin (2) and in the use position faces a neighboring formwork element (1) or building part, at least one depression (7) which is larger than said flat transponder (6), and the transponder (6) is arranged and held in the depression (7), surrounded by a boundary thereof, the at least one edge web (3) is formed from flat material and the depression (7) is embossed or the edge web (3) is a profile or extruded profile or hollow profile or rectangular profile and the depression (7) is formed or milled out by cutting or non-cutting removal of material, the depression (7) is closed on a side of the edge web (3) or the frame or the carrier (4) that is located in a direction toward a center of the formwork element (1) and the transponder (6) is held or fastened in the depression (7) by at least one of a plastic material or adhesive compound (8) and embedded into the plastic material or adhesive compound (8).

2. The formwork element as claimed in claim 1, wherein the flat material which forms the edge web(s) and which has the embossed depression (7) is a boundary of a hollow profile which is arranged at or encircles the edge of the formwork element (1).

3. The formwork element as claimed in claim 1, wherein the formwork element includes the lining skin and a metallic outer frame that includes the edge webs (3), which are made of flat or profiled material and protrude substantially at right angles to the lining skin (2), the cross section of the edge web (3) being directed away from the lining skin (2) up to a free or set-apart edge (3*a*), edge webs of neighboring ones of the lining panels indirectly or directly abutting the edge webs (3) in use and connectors acting for mutual fastening of the abutting edge webs, and the depression (7) receiving the transponder (6) is shaped, on an outer side (3*b*), which is located in the direction away from the center of the formwork element (1), of the edge web or webs (3), so as to recoil, relative to the outer side (3*b*), in a direction toward the center of the formwork element.

4. The formwork element as claimed in claim 3, wherein in the use position, the transponder (6) is sunk in the depression (7) sufficiently far that it is covered or concealed, at a side facing the outer side (3*b*) by the at least one of the plastic material or adhesive compound (8), and a covering of the transponder is flush with the outer face of the edge web (3) or outer frame or carrier (4).

5. The formwork element as claimed in claim 1, wherein the at least one of the plastic material or adhesive compound (8) is an epoxy resin-based two-component adhesive.

6. The formwork element as claimed in claim 1, further comprising a rectangular lining panel having at least two transponders (6) in mutually set-apart depressions (7) in the edge webs (3) or carriers (4) arranged at right angles or parallel to one another.

7. The formwork element as claimed in claim 6, the depressions (7) for a transponder (6) are provided in two of the edge webs (3) or carriers (4) close to a corner of the rectangular formwork element (1).

8. The formwork element as claimed in claim 7, wherein the two depressions (7) on the formwork element (1) oppose each other substantially centrally or on a line extending through the center of the formwork element (1).

* * * * *